US008872725B1

(12) United States Patent
Weller et al.

(10) Patent No.: US 8,872,725 B1
(45) Date of Patent: Oct. 28, 2014

(54) ELECTRONICALLY-TUNABLE FLEXIBLE LOW PROFILE MICROWAVE ANTENNA

(75) Inventors: Tom Weller, Lutz, FL (US); David Cure, Tampa, FL (US); Sergio Melais, Tampa, FL (US); Paul A. Herzig, St. Petersburg, FL (US)

(73) Assignees: University of South Florida, Tampa, FL (US); Raytheon Company, Waltham, MA (US)

( * ) Notice: Subject to any disclaimer, the term of this patent is extended or adjusted under 35 U.S.C. 154(b) by 1044 days.

(21) Appl. No.: 12/925,081

(22) Filed: Oct. 13, 2010

Related U.S. Application Data

(60) Provisional application No. 61/250,968, filed on Oct. 13, 2009.

(51) Int. Cl.
*H01Q 15/02* (2006.01)

(52) U.S. Cl.
USPC ..... 343/909; 343/700 MS; 343/756; 343/797

(58) Field of Classification Search
USPC ..... 343/818, 909, 700 MS, 756, 795, 797
See application file for complete search history.

(56) References Cited

U.S. PATENT DOCUMENTS

| | | | | |
|---|---|---|---|---|
| 5,652,598 | A * | 7/1997 | Campbell et al. | 343/791 |
| 6,906,674 | B2 * | 6/2005 | McKinzie et al. | 343/767 |
| 7,420,524 | B2 * | 9/2008 | Werner et al. | 343/909 |
| 7,982,673 | B2 * | 7/2011 | Orton et al. | 343/700 MS |
| 8,325,104 | B2 * | 12/2012 | Sim et al. | 343/909 |

OTHER PUBLICATIONS

Mehdi Hosseini and Mohammad Hakkak, Characteristics Estimation for Jerusalem Cross-Based Artificial Magnetic Conductors, 2008, IEEE Antennas and Wireless Propagation, vol. 7, pp. 58-61.*

Farrell et al., The Processing of Liquid Crystalline Polymer Printed Circuits, Electronic Components and Technology Conference, May 2002, pp. 667-671.

Hosseini et al., Design of a Novel AMC with Little Sensitivity to the Angle of Incidence and Very Compact Size, Proc. IEEE Int. Workshop Antenna Technol.: Small Antennas Novel Metamat., 2006, New York, pp. 1939-1942.

Fries et al., Direct Write Patterning of Microchannels, First International Conference on Microchannels and Minichannels, Apr. 24-25, 2003, Rochester, New York, pp. 1-7.

Kaydanova et al., Direct Inkjet Printing of Composite Thin Barium Strontium Titanate Films, J. Mater. Res., 2003, vol. 18, No. 12, pp. 2820-2825.

Hosseini et al., Characteristics Estimation for Jerusalem Cross-Based Artificial Magnetic Conductors, IEEE Antennas and Wireless Propagation Letters, 2008, vol. 7, pp. 58-61.

(Continued)

*Primary Examiner* — Tho G Phan

(74) *Attorney, Agent, or Firm* — Molly Sauter; Smith & Hopen, P.A.

(57) ABSTRACT

A low profile antenna that provides high isolation to backside radiation, is flexible to allow conformal mounting to a surface, and can be tuned over a wide frequency range is conceived. The design is suitable for applications that involve electromagnetic sensing for biomedical applications that require the antenna to be in contact with the material being monitored, providing the ability to adapt the frequency and input impedance via electronic control. It is also suitable for a range of communication applications that require low profile designs that mount conformably to structures such as helmet-mounted and vehicle-mounted configurations.

20 Claims, 2 Drawing Sheets

(56) References Cited

OTHER PUBLICATIONS

Laughlin et al., TEM and Electrical Analysis of Sputtered Barium Strontium Titanate (BST) Thin Films on Flexible Copper Substrates, Mat. Res. Soc. Symp. Proc., 2004, vol. 784, pp. C5.3.1-05.3.6.

Li et al., Locally Resonant Cavity Cell Model for Electromagnetic Band Gap Structures, IEEE Transactions on Antennas and Propagation, Jan. 2006, vol. 54, No. 1, pp. 90-100.

Melais, Design and Optimization of Broadband Planar Baluns and Dipole Antennas, M. S. Thesis Dept. Elect. Eng., University of South Florida, Tampa, Florida, 2005, pp. 1-107.

Naber et al., High-Performance Solution-Processed Polymer Ferroelectric Field-Effect Transistors, Nature Materials, 2005, vol. 4, pp. 243-248.

Simovski et al., Angular Stabilisation of Resonant Frequency of Artificial Magnetic Conductors for TE-Incidence, Electronic Letters, 2004, vol. 40, No. 2, pp. 92-93.

Sievenpiper et al., Two-Dimensional Beam Steering Using an Electrically Tunable Impedance Surface, IEEE Transactions on Antennas and Propagation, Oct. 2003, vol. 51, No. 10, pp. 2713-2722.

Spence et al., A Novel Miniature Broadband/Multiband Antenna Based on an End-Loaded Planar Open-Sleeve Dipole, IEEE Transactions on Antennas and Propagation, Dec. 2006, vol. 54, No. 12, pp. 3614-3620.

Sievenpiper et al., High-Impedance Electromagnetic Surfaces with a Forbidden Frequency Band, IEEE Transactions on Microwave Theory and Techniques, Nov. 1999, vol. 47, No. 11, pp. 2059-2074.

Yang et al., Reflection Phase Characterizations of the EBG Ground Plane for Low Profile Wire Antenna Applications, IEEE Transactions on Antennas and Propagation, Oct. 2003, vol. 51, No. 10, pp. 2691-2703.

* cited by examiner

ELECTRONICALLY-TUNABLE FLEXIBLE LOW PROFILE MICROWAVE ANTENNA

CROSS-REFERENCE TO RELATED APPLICATIONS

This application claims priority to U.S. Provisional Patent Application 61/250,968, entitled, "Flexible Low Profile Microwave Antenna," filed Oct. 13, 2009, the contents of which are herein incorporated by reference.

BACKGROUND OF THE INVENTION

Planar RF/microwave/mm-wave antennas, whether mounted to an airframe, vehicle, helmet or radio housing, are often backed by a conducting layer. Often times the antenna assembly also requires that the antenna be conformal to the conducting surface to which it is to be mounted. In the case of biomedical sensing, and in particular for radiometric sensing, it is necessary to have a flexible, low-profile antenna that is adjustable to the environmental loading effects that arise when the antenna comes into close proximity to an object or material (such as the human body). Antenna assemblies for use in biomedical radiometric sensing applications, such core body temperature measurement and pressure ulcers progress monitoring, require a flexible, low-profile antenna capable of adjusting to the environmental loading effects experienced by the antenna.

In the case of a radiometric antenna having a conductive layer backing, the presence of the conducting layer greatly limits not only the type of antenna element that can be used, but also the extent to which the profile of the antenna assembly can be reduced. In an antenna assembly employing an antenna element and a conducting layer, the conducting layer must be separated from the antenna element by an effectively large distance due to the natural tendency of ground currents to inhibit efficient radiation of the antenna element, thereby increasing the profile of the antenna assembly.

The microstrip patch antenna is commonly known in the art for the design of planar radiating elements above a conducting layer. The microstrip patch antenna is typically narrowband, and bandwidth enhancement requires a large antenna-to-ground separation. In a low-profile antenna, the large antenna-to-ground separation is undesirable because it increases the profile of the antenna assembly. Additionally, the designs known in the art for microstrip patch antennas of this type do not allow for end-fire radiation.

Commonly, there is a need to severely limit background radiation for highly sensitive sensing applications. The need to severely limit background radiation in these applications requires backing the printed antenna element with ground plane shielding. However, it is often also required that these antenna assemblies are low profile antenna assemblies and as such, the ground plane must be placed in close proximity to the antenna element to reduce the profile of the assembly which also results in poor radiation characteristics of the antenna due to cancellation from image currents. Moreover, in the case where multiple antennas share the same ground plane, the surface currents add unwanted mutual coupling.

It is known in the art to reduce the ground interference of the low-profile antenna assembly by introducing a textured periodic surface above the ground plane that alters electromagnetic characteristics of the ground place. This textured periodic surface is known in the art as a high impedance surface, frequency-selective surface (FSS) or electromagnetic band gap (EBG) structure and prevents the propagation of radio frequency surface currents within the band-gap structure. The limiting effect of ground plane interference has been addressed by individuals in the art through electromagnetic band-gap (EBG) technology. However, work in the art has not addressed the need for tuning of the antenna to adjust to environmental loading effects experienced by the antenna when it is placed in close proximity to an object or material.

Accordingly, what is needed in the art is a low-profile, tunable electronic-band gap antenna assembly that is also flexible and therefore suitable for conformal mounting.

SUMMARY OF INVENTION

The present invention provides a low profile antenna that utilizes a flexible substrate with embedded elements to provide frequency tuning. A particular embodiment of the invention consists of a printed dipole that is loaded with two parallel sleeves, and has parasitic capacitive loading at the ends of the dipole arms. The loading elements in this embodiment offer design miniaturization. This design is attractive due to its high radiation efficiency and inherently broad bandwidth.

In a particular embodiment, the present invention provides a low profile microwave antenna assembly including, a planar antenna fabricated on a first flexible polymer substrate, a ground plane and a segmented textured periodic surface. Each of the segments of the segmented textured periodic surface are fabricated on a hard substrate and then integrated into a flexible substrate so that the overall textured periodic structure is flexible. The segmented textured periodic surface and the embedded reactance devices within the second flexible polymer substrate are positioned between the first flexible polymer substrate and the ground plane.

In a specific embodiment, the flexible polymer substrate is a liquid crystal polymer substrate and the planar antenna is an end-loaded planar open sleeve dipole (ELPOSD) antenna.

The segmented textured periodic surface in accordance with the present invention may be a high impedance surface, a frequency-selective surface or an electromagnetic band gap (EBG) surface. In a particular embodiment, the textured periodic surface is a Jerusalem Cross structure comprising a plurality of conductive patch elements electromagnetically-coupled to the ground plane to form a continuous textured metal structure. In a specific embodiment, the textured periodic surface is fabricated on a magnesium oxide substrate and the embedded reactance devices of the textured periodic surface are ferroelectric devices.

The present invention may further include one or more microwave monolithic integrated circuit (MMIC) integrated onto the first polymer substrate.

In an additional embodiment, low-density, low-loss material layers are positioned between the first flexible polymer substrate and the second flexible polymer substrate and between the second flexible polymer substrate and the ground plane.

The present invention enables antenna elements to be in close proximity to conducting layers without severely diminishing their performance, while also providing frequency tuning to enhance operational bandwidth. The flexible, low profile antenna in accordance with the present invention has the capability to electronically adjust to the environmental loading effects that arise when the antenna comes into close proximity to an object or material. The added feature of flexibility will increase the range of platforms into which such a technology can be integrated.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1:
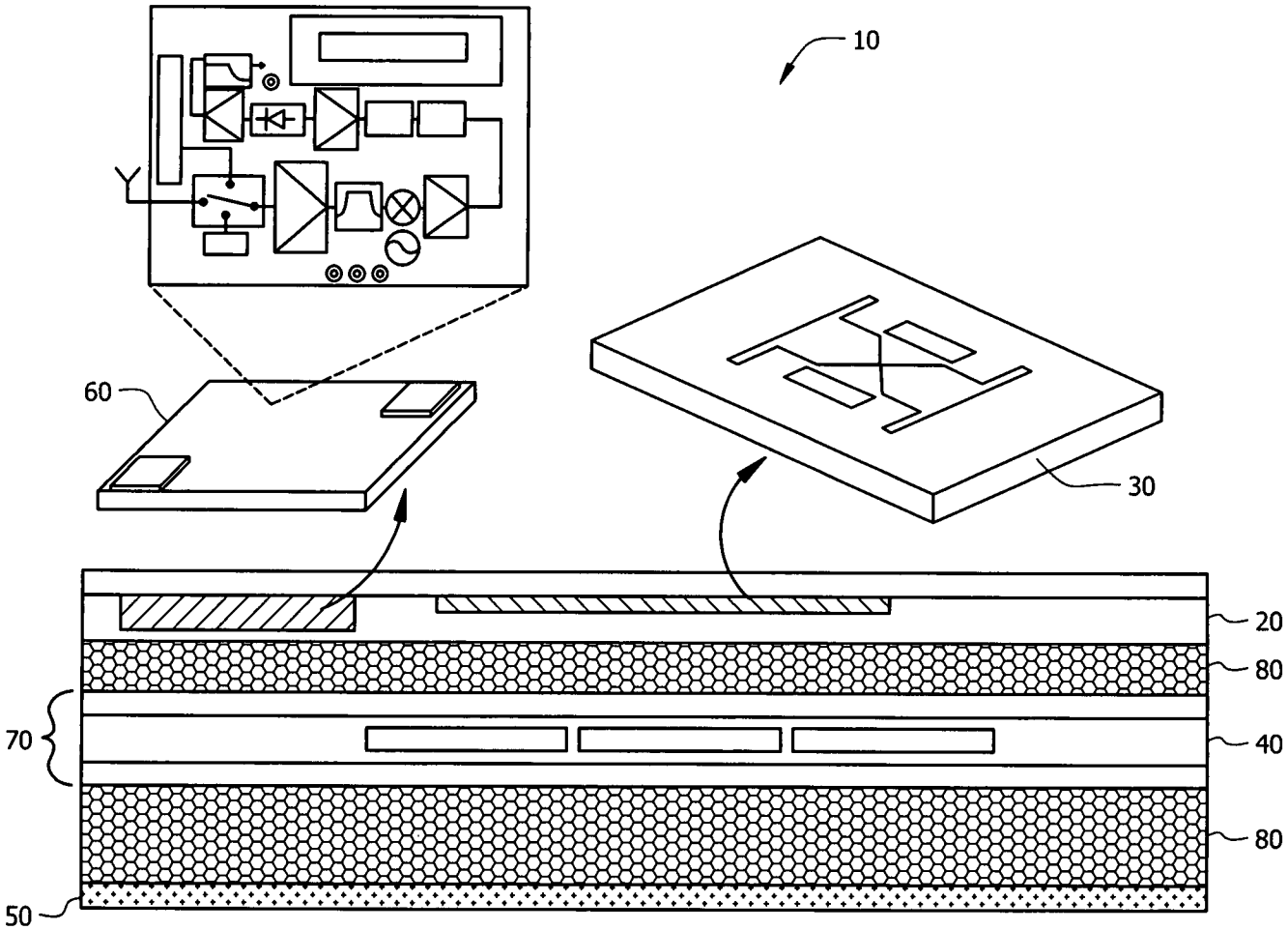
FIG. 1 is a cross-sectional view of the conformal antenna assembly and chip-scale radiometer in accordance with an embodiment of the present invention.

With reference to FIG. 1, an embodiment of the antenna assembly 10 of the present invention includes a flexible polymer substrate 20, which supports the antenna 30 and allows the radiating surface to conform to the non-planar shape of the object while the tunable ferroelectric layer 40 provides the capability for frequency adjustment of the inherently band-limited, high impedance (electromagnetic band-gap) layer. This high-impedance layer 40 decouples the antenna 30 from the conducting ground plane 50. Along the antenna plane it will be possible to collocate microwave monolithic integrated circuits (MMICs) 60 that comprise an analog RF front-end.

In a particular embodiment of the present invention, the high impedance surface 40 comprises a plurality of segments, each of the segments begin created on a hard substrate such as MgO. The segments are integrated into a low loss, polymer substrate stack 70 to form the segmented high impedance surface that supports the dipole antenna 30 and ground plane 50 as shown in FIG. 1. Fabricating the high impedance surface 40 as segments of MgO integrated within a flexible polymer substrate, creates a flexible high impedance surface 40. The methodology is essentially that of a multi-chip module approach, or system in a package (SIP), with the distinction that the system is a 3-D electromagnetic structure as opposed to the discrete circuit applications that have been the focus of intense research. The MgO layer segments with the EGB patterns can be populated with the variable reactance devices, in order to control the resonant frequency of the EBG cells and thus the center frequency of the overall antenna sub-system. Liquid crystal polymer (LCP), which can be chemically etched to accommodate the MgO chips, can be used as the host substrate material. The thinner LCP layers of the antenna assembly can be combined with thicker low loss materials, such as polytetrafluoroethylene, that is machined into a honeycomb-like manner 80 in order to balance structural integrity with the required amount of flexibility.

Figure 2:
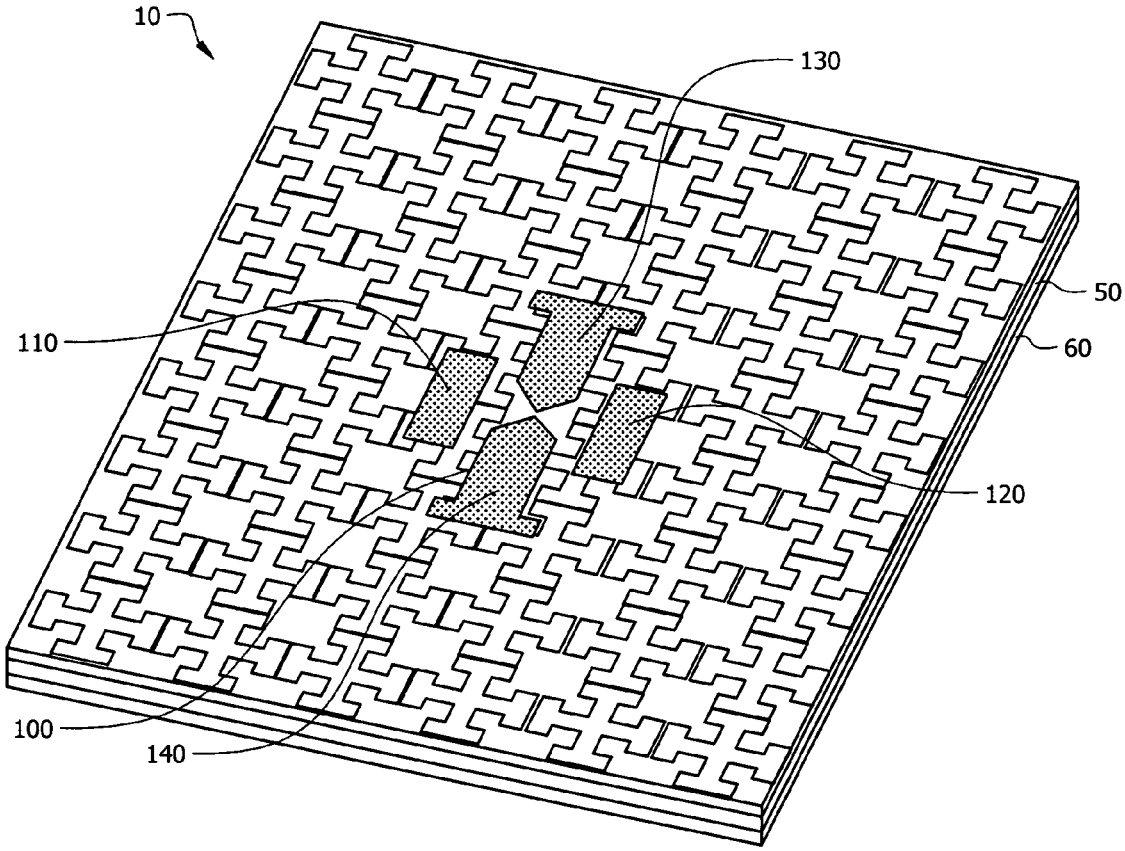
FIG. 2 illustrates an end-loaded planar open sleeve dipole and underlying electromagnetic band-gap surface in accordance with and embodiment of the present invention.

With reference to FIG. 2, in a particular embodiment the low-profile antenna assembly 10 uses an end-loaded planar open sleeve dipole (ELPOSD) antenna element. The embodiment consists of a printed dipole 100 that is loaded with two parallel sleeves 110, 120, and has parasitic capacitive loading 130, 140 at the ends of the dipole arms. The loading elements offer design miniaturization. This embodiment is attractive due to its high radiation efficiency and inherently broad bandwidth. It has been shown that this antenna is applicable for operation across the desired frequency range from 700 MHz to 1.4 GHz and will have dimensions on the order of 1 cm×5 cm.

The need to severely limit background radiation requires that the ELPOSD be backed by ground plane shielding. Unfortunately, for low-profile antennas, having the ground plane in close proximity to the antenna results in poor radiation characteristics due to cancellation from image currents. Moreover, in the situation where multiple antennas share the same ground plane, the surface currents add unwanted mutual coupling. The ground interference issue can be resolved by introducing a textured periodic surface above the ground that alters its electromagnetic characteristics. This structure is known as a high impedance surface, frequency-selective surface (FSS) or electromagnetic band gap (EBG) structure, and operates in a similar fashion as two-dimensional photonic crystals to prevent the propagation of RF surface currents within the band-gap.

The embodiment illustrated in FIG. 2 is referred to as a Jerusalem cross 150 and requires no direct electrical connection to the underlying ground 160. Rather, the surface contains patches that are electromagnetically-coupled to the ground plane and form a continuous textured metal structure. As the features are electrically small, the electromagnetic properties can be described using lumped capacitors (between cells) and inductors (cross sections). These lumped elements behave as a parallel LC circuit filtering the flow of current along the sheet. Using different EBG approaches, it has been demonstrated that frequency tuning can be achieved by integrating semiconductor diodes into the surface pattern.

A major challenge in the art that is addressed by the present invention is the integration of high performance tunability in flexible antenna systems. The choices that are available for achieving tunability can be broadly categorized as either semiconductor-based, field-tunable oxides or micro electro mechanical systems. In virtually all microwave applications, performance and cost are the most critical factors that drive technology-related decisions and high-quality field-tunable oxides are generally regarded as the best compromise among the three categories. The quality of the films and the performance of the devices, measured in terms of dissipation loss and percent tunability, are optimum when high process temperatures, vacuum deposition and micron- or sub-micron scale lithography can be used. To meet these optimum objectives, the present invention suggests a hybrid method in which ferroelectric devices used for frequency tuning are fabricated on a hard substrate using sputtering and semiconductor processing techniques, and subsequently packaged within the flexible substrate in a multi-chip-module (MCM) approach.

In addition to improvements in high-performance ferroelectric device technology, the present invention will advance the field of reconfigurable planar antenna design and therefore broadly impact many areas of wireless sensing and communications.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A low profile microwave antenna assembly comprising:

a planar antenna fabricated on a first flexible polymer substrate;

a ground plane; and a flexible segmented textured periodic surface positioned between the first flexible polymer substrate and the ground plane, the flexible segmented textured periodic surface comprising a plurality of segments, each segment comprising a hard substrate and at least one frequency tuning device fabricated on the hard substrate and the plurality of segments integrated into a second flexible polymer substrate to form the flexible segmented textured periodic surface.

2. The antenna assembly of claim 1, wherein the first flexible polymer substrate and the second flexible polymer substrate are liquid crystal polymer.

3. The antenna assembly of claim 1, wherein the planar antenna is an end-loaded planar open sleeve dipole (ELPOSD) antenna.

4. The antenna assembly of claim 3, wherein the end-loaded planar open sleeve dipole (ELPOSD) antenna further comprises:

two dipole arms;

two parallel sleeves positioned adjacent to the two dipole arms; and two parasitic capacitive loading elements positioned at the distal ends of the two dipole arms.

5. The antenna assembly of claim 3, wherein the second low-density, low-loss material layer is polytetrafluoroethylene machined into a honeycomb-like structure.

6. The antenna assembly of claim 1, wherein the planar antenna is printed on the first flexible polymer substrate.

7. The antenna assembly of claim 1, wherein the flexible segmented textured periodic surface is a high impedance surface.

8. The antenna assembly of claim 1, wherein the flexible segmented textured periodic surface is a frequency-selective surface.

9. The antenna assembly of claim 1, wherein the flexible segmented textured periodic surface is an electromagnetic band gap (EBG) surface.

10. The antenna assembly of claim 1, wherein the flexible segmented textured periodic surface is a Jerusalem Cross structure comprising a plurality of conductive patch elements electromagnetically-coupled to the ground plane to form a continuous textured metal structure.

11. The antenna assembly of claim 1, wherein the frequency tuning device is a ferroelectric device.

12. The antenna assembly of claim 1, further comprising at least one microwave monolithic integrated circuit (MMIC) integrated into the first flexible polymer substrate.

13. The antenna assembly of claim 1, further comprising a first low-density, low-loss material layer positioned between the first flexible polymer substrate and the second flexible polymer substrate.

14. The antenna assembly of claim 13, wherein the first low-density, low-loss material layer is polytetrafluoroethylene machined into a honeycomb-like structure.

15. The antenna assembly of claim 1, further comprising a second low-density, low-loss material layer positioned between the second flexible polymer substrate and the ground plane.

16. The antenna assembly of claim 1, wherein the hard substrate is magnesium oxide.

17. A low profile microwave antenna assembly comprising:

an end-loaded planar open sleeve dipole antenna fabricated on a first liquid crystal polymer substrate;

a ground plane; and a flexible segmented textured periodic surface positioned between the first flexible polymer substrate and the ground plane, the flexible segmented textured periodic surface comprising a plurality of segments, each segment comprising a hard substrate and at least one frequency tuning device fabricated on the hard substrate and the plurality of segments integrated into a second flexible polymer substrate to form the flexible segmented textured periodic surface.

18. The antenna assembly of claim 17, wherein the segmented textured periodic surface is a Jerusalem Cross structure and the frequency tuning device is a ferroelectric device.

19. A low profile microwave antenna assembly comprising:

an end-loaded planar open sleeve dipole antenna fabricated on a first flexible polymer substrate;

a ground plane; and a flexible electromagnetic band gap surface positioned between the first flexible polymer substrate and the ground plane, the flexible electromagnetic band gap surface comprising a plurality of electromagnetic band gap segments, each electromagnetic bad gap segment comprising a hard substrate and at least one ferroelectric device fabricated on the hard substrate, the plurality of electromagnetic band gap segments integrated into a second flexible polymer substrate to form the flexible electromagnetic band gap surface.

20. The device of claim 19, wherein the first flexible polymer substrate and the second flexible polymer substrate are liquid crystal polymer.

* * * * *

UNITED STATES PATENT AND TRADEMARK OFFICE

CERTIFICATE OF CORRECTION

PATENT NO. : 8,872,725 B1
APPLICATION NO. : 12/925081
DATED : October 28, 2014
INVENTOR(S) : Tom Weller et al.

It is certified that error appears in the above-identified patent and that said Letters Patent is hereby corrected as shown below:

In the Claims

Column 6, Claim 19, Line 35 should read:

-- segments, each electromagnetic band gap segment com- --.

Signed and Sealed this
Tenth Day of March, 2015

Michelle K. Lee

Michelle K. Lee
*Deputy Director of the United States Patent and Trademark Office*